US005378962A

United States Patent [19]

Gray et al.

[11] Patent Number: 5,378,962

[45] Date of Patent: Jan. 3, 1995

[54] METHOD AND APPARATUS FOR A HIGH RESOLUTION, FLAT PANEL CATHODOLUMINESCENT DISPLAY DEVICE

[75] Inventors: Henry F. Gray, Alexandria, Va.; Ronald R. Price, Stevensville, Md.

[73] Assignee: The United States of America as represented by the Secretary of the Navy, Washington, D.C.

[21] Appl. No.: 889,885

[22] Filed: May 29, 1992

[51] Int. Cl.[6] ..... H01J 29/10

[52] U.S. Cl. ..... 313/495; 313/474; 313/475; 313/400

[58] Field of Search ..... 313/422, 461, 462, 463, 313/474, 475, 478, 495, 309, 336, 351, 400, 465, 399; 358/901, 250, 252

[56] References Cited

U.S. PATENT DOCUMENTS

| | | | |
|---|---|---|---|
| 2,091,152 | 8/1937 | Malpica | 313/474 |
| 3,019,344 | 1/1962 | Seidman et al. | 312/465 |
| 3,907,403 | 9/1975 | Maeda | 313/475 |
| 3,992,644 | 11/1976 | Chodil et al. . | |
| 4,103,204 | 7/1978 | Credelle . | |
| 4,131,823 | 12/1978 | Credelle et al. | 313/400 |
| 4,252,408 | 2/1981 | Parsons et al. | 313/475 |
| 4,277,114 | 10/1981 | DeJule . | |
| 4,307,507 | 12/1981 | Gray et al. . | |
| 4,513,308 | 4/1985 | Greene et al. . | |
| 4,578,614 | 3/1986 | Gray et al. . | |
| 4,857,799 | 8/1989 | Spindt et al. . | |

OTHER PUBLICATIONS

Robert Gomer, "Field emission and field ionization", American Vacuum Society Classics, AIP, pp. 1–30, 1993.

J. J. Dalton et al, "CRT Optical Tunnel", IBM Technical Disclosure Bulletin, vol. 9, No. 7, Dec. 1966.

R. Roux, "Microtips Enabel AC Addressable Flat-Panel Display", Fiberoptics World, vol. 28, No. 5, May, 1992, pp. 30–31.

*Primary Examiner*—Donald J. Yusko
*Assistant Examiner*—N. D. Patel
*Attorney, Agent, or Firm*—Thomas E. McDonnell; Charles J. Stockstill

[57] ABSTRACT

A high resolution, cathodoluminescent display screen or device and a method of producing such a display device is disclosed. The display screen includes a plurality of channel structures having longitudinal ends, a transparent medium formed in a plane to which the channel structures are fixed with one longitudinal end thereof oriented toward the plane of the transparent medium, and a cathodoluminescent material deposited on the channel structures whereby incident electrons and light generated by the incident electrons are directed along the channel structures. Preferably, the display screen also includes a mechanism for removing built up charge from the display screen, such as conductive channel structures and/or a conductive transparent medium. The cathodoluminescent material can include phosphors, and for producing a color display, different materials producing different colors would be used. In one preferred embodiment, the channel structures are tubules. Alternately, the channel structures can be channel plates or other structures providing channeling structures. In the preferred embodiment, the transparent medium is glass. However, the transparent medium could be quartz or some other equivalent material. In order to provide a display device the display screen is then mated with an addressable electron source for generating electrons incident on the cathodoluminescent material of selected channel structures. Preferably, the electron source means includes a field emitter array with a reflecting surface.

29 Claims, 4 Drawing Sheets

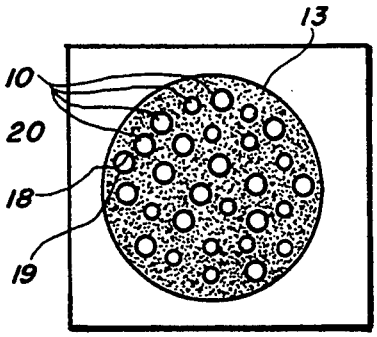
FIG. 2
FIG. 3
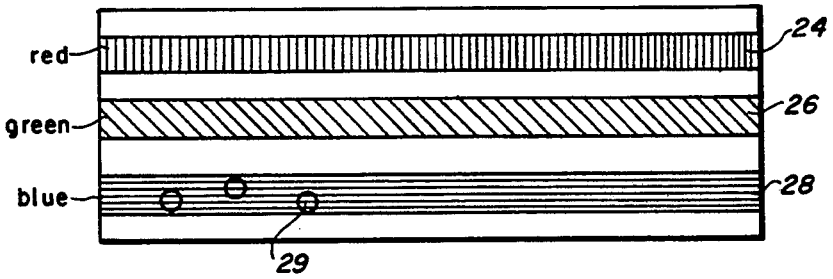
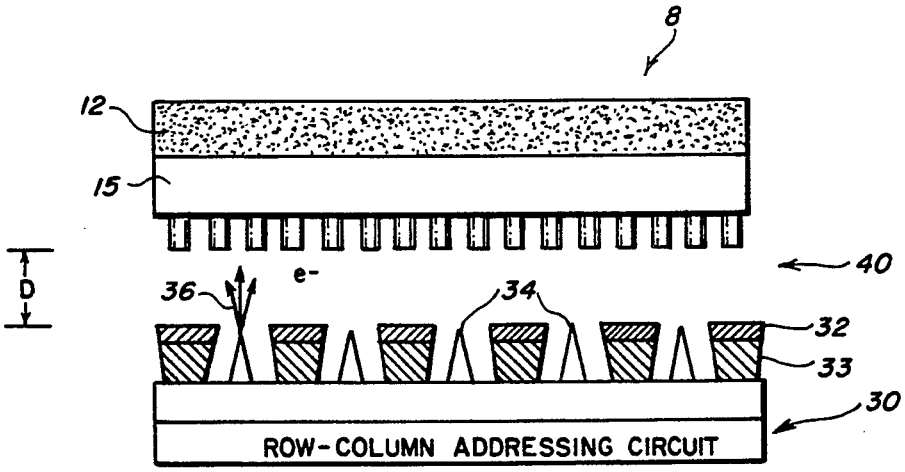
FIG. 4

METHOD AND APPARATUS FOR A HIGH RESOLUTION, FLAT PANEL CATHODOLUMINESCENT DISPLAY DEVICE

FIELD OF THE INVENTION

The present invention relates generally to a flat cathodoluminescent display device which is actuated by a flat row/column addressable associated electron source, and more particularly to a flat panel cathodoluminescent screen where the screen uses cathodoluminescent coated channel forming structures to direct the generated light to produce a high resolution display screen and a flat optically reflecting addressable electron source.

BACKGROUND OF THE INVENTION

Most cathodoluminescent displays are produced by a number of different methods that deposit a granular phosphor onto a conductive glass substrate. These known methods of phosphor deposition incorporate a patterning process to provide multicolors, such as red, green and blue phosphor dot clusters or stripe clusters, which create a spectrum by color addition. However, there are a number of disadvantages inherent in screens produced by these known methods.

One disadvantage is that the light generated in each grain comes out in all directions. This has a number of undesirable consequences. For example, because not all the light comes out to the viewer, there is a significantly lower usable light efficiency. In addition, the light which scatters into neighboring grains results in decreased spatial resolution of the screen. Finally, the light that scatters into neighboring grains can excite these neighboring grains and cause them to radiate different, unwanted colors or at least unwanted radiation so that spatial and chromatic resolution is decreased.

With the prior art displays, it will also be appreciated that the electron beam can scatter into neighboring grains which results in a number of deleterious consequences. For example, such scatter can excite neighboring grains so that spatial resolution is decreased or different colors are introduced. In addition, electrons deposited from the electron beam on to the phosphor screen can significantly charge up the non-conducting phosphor. One consequence of this charging up is that the incident electron beam is deflected to neighboring grains instead of hitting its intended target grain, thereby decreasing spatial resolution. Another consequence of charge up is that the impinging electron energy distribution is significantly spoiled, thereby decreasing light output and light output uniformity. Additionally, if the phosphors are allowed to charge up too much, the charged phosphor screen can catastrophically break down (voltage breakdown). This breakdown problem results in flickering, non-uniform brightness and blooming resulting from both the dispersion in the impinging electron energy and the redirection of the electron trajectory. Finally, the charge-up of the phosphor, which creates charge-induced defects, can change the cathodoluminescent properties and lower the useful lifetime of the phosphor.

A further disadvantage of the existing process of phosphor deposition is the fact that the phosphor discharge path is long. This means that a relatively high energy electron beam is required. Also, the boundary between different colors is very hard to control.

It will be appreciated from the foregoing that the production of a cathodoluminescent display screen by the existing process of phosphor deposition onto a glass substrate is limited in terms of the clarity of the image produced.

In U.S. Pat. No. 4,857,799 (Spindt, et al), the use of field emission cathodes for providing an electron stream to a flat screen cathodoluminescent display coated with luminescent phosphor is disclosed. The cathodes are incorporated into a display backing structure.

In U.S. Pat. No. 4,277,114 (De Jule), the use of a cathodoluminescent display panel which incorporates a gas discharge device is disclosed. The gas is under pressure and the use of phosphor disposed on the transparent walls of the cavity surrounding a positive column is disclosed. The disclosed device uses plasma to generate an electron stream.

In U.S. Pat. No. 4,103,204 (Credelle), the use of a group of channels for directing an electron path is disclosed. A gun structure selectively injects electrons into the channels and slalom focusing is used to guide the electrons down the path to the display device. The use of a channeling technique is provided to improve picture quality.

In U.S. Pat. No. 3,992,644 (Chodil, et al) a cathodoluminescent device is disclosed which displays colors. The disclosed device uses a hollow cylindrical cathode shell and an anode that is flush with the shell.

Field emitter arrays which are designed for row-column addressability of general interest are disclosed in the following U.S. Pat. Nos.: 4,578,614 (Gray, et al), 4,307,507 (Gray, et al) and 4,513,308 (Greene, et al).

SUMMARY OF THE INVENTION

In accordance with the present invention, a high resolution, cathodoluminescent display device and a method of producing such a display device are provided. The device consists of a flat screen and a flat addressable electron source. The display screen comprises a plurality of channel structures having longitudinal ends, a transparent medium or face plate formed in a plane to which the channel structures are fixed with one longitudinal end thereof oriented toward the plane of the transparent medium or face plate, and a cathodoluminescent material deposited on, in, and/or around the channel structures whereby incident electrons and light generated by the incident electrons are directed in the direction of the channel structures.

Preferably, the display screen also includes a means for removing built up charge from the display screen. For example, the means for removing can include conductive channel structures. Alternatively or additionally, the means for removing can include a conductive transparent face plate.

The cathodoluminescent material can include phosphors, or may be, for example, yttrium-iron-garnet. For producing a color display, different materials producing different colors would be used.

In one preferred embodiment, the channel structures are tubes. Alternately, the channel structures can be channel plates or other elements providing channeling structures.

In the preferred embodiment, the transparent face plate is glass. However, the transparent face plate could be quartz, sapphire or some other equivalent material.

In order to provide a display device, the display screen is then mated with an addressable flat electron source means for generating electrons incident on the cathodoluminescent material in and around the selected channel structures. Preferably, the electron source means is comprised of a field emitter array. Other alternative electron sources include: a back biased p-n junction, a photoemitter, and a metal-insulated-metal emitter, etc.

The method for producing a cathodoluminescent display device according to the present invention includes the production of a display screen. Production Of the display screen is accomplished by forming a plurality of channel structures having longitudinal ends, depositing a cathodoluminescent material on, in and around the channel structures, and fixing the channel structures to a transparent medium or face plate with one longitudinal end facing toward the plane of the transparent face plate such that incident electrons and light generated by the incident electrons are transported along the direction of the channel structures. To produce the display device, an addressable optically reflecting electron source such as a field emitter array is mated to the display screen with a vacuum therebetween.

This device has the advantages of increasing efficiency, redirecting the scattered light and/or scattered electrons in the desired direction, increasing spatial resolution, increasing chromatic purity, increasing the dynamic range of brightness, increasing contrast, localizing the electron source in a flat addressable source making the display flatter, permitting lower power operation, decreasing charging problems and thus increasing uniformity of the display, and decreasing "blooming".

Other features and advantages of the present invention are set forth in, or will be apparent from, the following detailed description of the preferred embodiments of the invention taken in conjunction with the accompanying drawings.

BRIEF DESCRIPTION OF THE DRAWINGS

The invention will become more readily apparent from the following exemplary description taken in conjunction with the accompanying drawings, in which:

FIG. 1(*b*) is a schematic cross-sectional side view of the tubule arrangement of FIG. 1(*a*), with one end of the tubules attached to a substrate;

FIG. 2 is a schematic top plan view of an alternative arrangement of tubules defining a single pixel;

FIG. 3 schematically illustrates bands of pixels forming red, green and blue stripes; and FIG. 4 shows a schematic side view of the tubules arranged on a substrate with a field emitter array positioned a preset distance from one end of the tubules.

DETAILED DESCRIPTION OF THE PREFERRED EMBODIMENTS

Figure 1A:
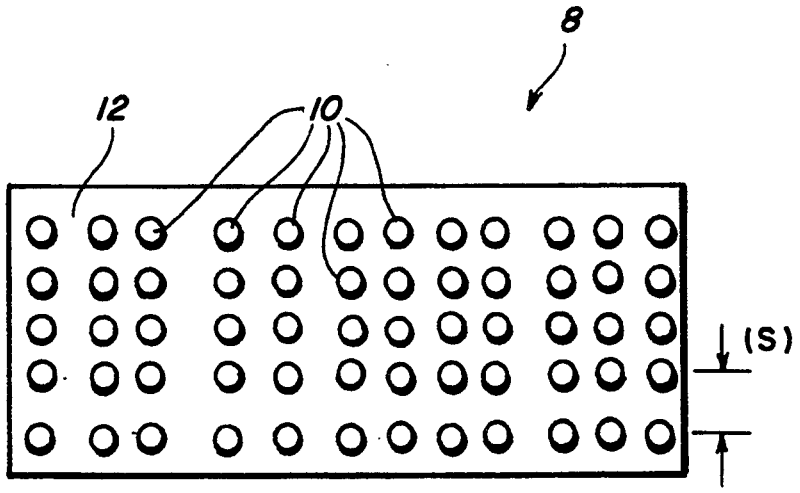
FIG. 1(*a*) is a schematic top plan view of an arrangement of tubules on a conductive substrate according to the invention.
Figure 1B:
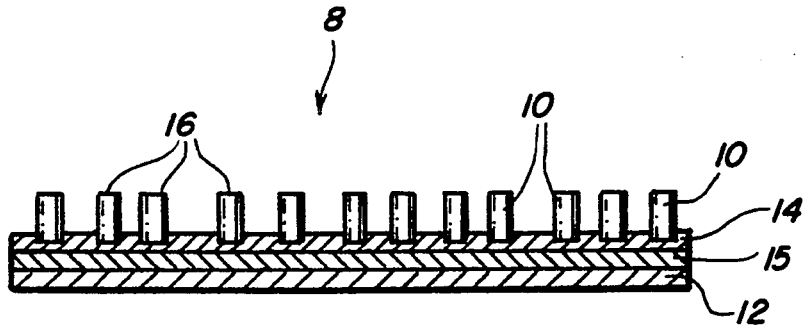

With reference to the drawings in which like numerals represent like elements throughout the several views, a display screen 8 according to the invention is depicted in FIGS. 1(*a*) and 1(*b*). Display screen 8 comprises a plurality of channel structures, which in this preferred embodiment are cylindrically shaped microtubules 10 (or simply "tubules", as will be used hereinafter) attached to a transparent substrate or face plate 12. However, the tubules may be of any shape, e.g., rectangular, octangular, triangular, etc., and there is no defined spacing, the tubules may be closely packed so as to touch each other or they may be separated. Also the tubules in a package do not have to be of the same diameter or shape. Transparent substrate 12 is preferably glass, but it could be other transparent substances as well such as sapphire or quartz. As shown in FIG. 1(*b*), tubules 10 are attached at one end to transparent substrate 12 by means of an adhesive layer 14. Transparent substrate 12 is preferably made conductive by means of a conductive coating 15 applied to transparent substrate 12. In the preferred embodiment, adhesive layer 14 is also made conductive.

It should initially be appreciated that tubules 10 can either be immersed in transparent substrate 12 (or another suitable transparent face plate or medium) or simply attached at one end as described above. In this regard, if the medium is suitably designed, the medium itself could form light conducting channels in between the tubules provided and such light conducting channels used in place of the tubules. Alternatively, tubules themselves could be interconnected to form a plate or the like.

In a preferred embodiment, tubules 10 are cylindrical in shape and have an outside diameter range of 0.1 to 3 micrometers and a length of 1 to 25 micrometers. Tubules 10 are conveniently formed from self-assembling biological molecules, or from organic or inorganic chemicals or materials. Preferably, each tubule 10 is coated with a metal, or is formed from a conductive substrate, such as a metal. An alternative to conductive tubules 10 is to utilize non-conductive tubules 10, but this method is less efficient and some charging problems would occur (unless the cathodoluminescent material, discussed subsequently, is conducting). The tubules 10 should preferably have a wall thickness of 0.05 micrometer or less.

It will thus be appreciated that, in general, the part of display screen 8 which might be contacted by an electron stream should be conductive or charging problems will result. Also, any part of display screen 8 which determines the potential on display screen 8 or in the vacuum space near the electron path must be conducting, or electron trajectories and/or energies will be adversely affected.

It should be noted that channel structures other than tubules 10 (e.g., rectangular, octangular, triangular, etc.) may be used as long as such structures function similarly. In particular, such structures must channel light and/or electrons, and be smaller than the resolution of the eye or viewing element. Thus, it will be appreciated that the cross-sectional shape of the channels provided is not important, so long as a defined channelling path is provided. Examples of other channel structures known in the art but used for other purposes include the following: micro-channel plates such as nucleopore membrane filters and anapore membranes either etched or formed from a glass face plate, or structures micromachined in foils; deposited on films such as polyamide or dielectrics or metals, etc.; and structures formed by removing a template-like structure.

Tubules 10 are applied to transparent substrate 12 in a suitable closely packed arrangement, such as the arrangement shown in the top plan view of FIG. 1(*a*), where tubules 10 are presented in orderly rows and (offset) columns. The distance, S, between adjacent tubules can take various values, the preferred value being in the range of 0.0 to 2.0 microns. In some embodiments, the tubules may touch each other. Although in the preferred embodiment the tubules are of a similar size and cross-section, there is no requirement that they be of the same uniform shape; the tubules may be of varying cross-sections and sizes within the same arrangement. Actually, the tubule arrangement will probably be less uniform in an actual embodiment, and will resemble the view looking downward into, for example, a firmly packed box of straws. FIG. 2 shows such an arrangement, and with tubules 10 of different sizes and thus more randomly dispersed in FIG. 2. It should be noted that the tubule 10 spacing does effect performance because the more tightly packed the structure, the better the spatial resolution. Thus, when display screen 8 is designed for viewing with a human eye, the spacing of the tubules would then be chosen to be less than the resolution of the eye. There would be no need for better resolution than the eye is capable of in such a situation. Similarly, where a greater or lesser chosen resolution, the spacing of the tubules would be chosen to be less than that resolution.

As noted above, tubules 10 in the depicted embodiment are affixed at one end to transparent substrate 12 by means of an adhesive layer 14, which could be an epoxy or a polyamide binder. Display screen 8 as shown was formed by placing a glass substrate in a receptacle and introducing a polyamide binder (or other suitable material). Then, the tubules were inserted into the receptacle and a magnetic or electric field was applied causing the tubules to line up with an axis perpendicular to the substrate. In this orientation, the tubules settled onto the substrate where the tubules were attached by polymerization of the binder.

An alternate method for the assembly of tubules 10 is to position them in a suitable polymeric material, orient tubules 10 in the same manner as before (e.g., by applying either an electrical or magnetic field in an appropriated direction so that tubules 10 are normal to a planar surface), and then polymerize the plastic (polymeric material) to hold tubules 10 in alignment. After this is accomplished, the polymer matrix so formed is cut to form a thick film such that tubules 10 are cross-cut at an interval equal to the desired tubule length. This forms a tubule assembly in the thick film. The tubule assembly is then attached as a film to a separately provided transparent substrate 12.

Following either of the above procedures in affixing the array of tubules 10 to transparent substrate 12, most of the epoxy or polyamide binder material (or the polymeric material if the alternate step is used) is removed leaving only that necessary to retain adhesion of the tubules to the substrate. This can be done either by solvation, or by etching in a plasma reactor such as a planar or barrel reactor using an inert or reactive ion etch to remove most of the material. The resulting structure from either procedure is a tubule arrangement, one example of which is shown schematically in FIGS. 1(*a*) and 1(*b*).

The particular diameter of each tubule 10 and the spacing between tubules 10 are variable to yield densities for differing applications, and thus accommodate optimization. Such applications, by way of example, could be for high or low electron energies, for different mean free paths of the excited photons or for varying the mean free paths of the electrons for the desired spacial resolution and in providing for a number of colors.

The assembly of tubules 10 is next masked for deposition and delineation of a cathodoluminescent material, such as by use of a circular mask 13 applied over an outermost (second) end 16 of tubules 10 to form a circular tubule display pixel, as shown in FIG. 2. Any cathodoluminescent material, such as phosphor or garnet materials, that produce high brightness visible light may be utilized for this purpose. In the preferred embodiment, phosphor is utilized. The cathodoluminescent material is deposited on the masked assembly with a thickness sufficient to stop impinging electrons. This cathodoluminescent material is preferably deposited in tubules 10 to fill tubules 10 as well as in between tubules 10 to fill the region between tubules 10. In other embodiments, the cathodoluminescent material could be provided in a preselected region of the channel structure at the following locations: in tubules 10, on tubules 10, in the regions in between tubules 10, or a combination of these locations (and in the preferred embodiment and others, as noted, all of these locations). This cathodoluminescent material is shown by the stippled region 20. By imbedding tubules 10 in just one color of cathodoluminescent material, a monochrome display is created. With such a configuration, the excitation could occur within, around or on the outside of tubules 10.

If more than one type of cathodoluminescent material is deposited, e.g. more than one cathodoluminescent material color is used or a series of cathodoluminescent materials are deposited that have different decay times, then the assembly can be remasked and the additional cathodoluminescent materials deposited. Electrophoresis can be utilized to deposit more than one type or color of cathodoluminescent material. By placing an appropriate voltage on any particular conductive coating 15 (conducting transparent metallization interconnect, e.g. indium-tin-oxide), the cathodoluminescent material will be electro-deposited thereon. For example, a blue cathodoluminescent material is first deposited by selectively charging the interconnect and then the procedure is repeated for green, red, etc. until the desired regions are coated with the selected colors. Other techniques could also be used, for example, in reverse, by biasing the appropriate electrodes where one does not want cathodoluminescent materials to go. Alternately, the assembly can be masked using standard lithography techniques known in the art, and deposition of the cathodoluminescent material can be accomplished by a variety of procedures such as by sputtering, evaporation, chemical vapor deposition, printing technologies or deposition from aqueous or other liquid solutions or mixtures. Other color systems besides red, green, and blue could also be used, such as magenta, cyan, yellow and black or two-color systems, such as red and green, yellow and blue, etc.

The deposition of the cathodoluminescent materials can also be done without the use of a mask if conductive coating 15 (shown in FIG. 1(*b*)) applied to transparent substrate 12 is a conducting transparent interconnect or another suitable conducting material and is patterned first. In a preferred embodiment, indium-tin-oxide (ITO) will be used as the conducting interconnect (although other conducting, transparent, coatings made of a variety of materials could be used on transparent substrate 12). The cathodoluminescent materials can be applied by using electrophoresis techniques, whereby each cathodoluminescent material pixel can be deposited separately or in groups. Stripes of colors are illustrated in FIG. 3 which shows a red stripe 24 comprised of red tubule assemblies, followed by a green stripe 26 of green tubule assemblies, and a blue stripe 28 of blue tubule assemblies.

A preferred technique for applying the cathodoluminescent material to the tubule assembly is as follows. Initially, the hollow interiors of tubules 10 are preloaded (filled) with cathodoluminescent material prior to the orientation of tubules 10 on substrate 12 as discussed above. The colors (such as red and green) of the tubules 10 may be grouped together or randomly mixed, consist of a single color, or different colors, and may be grouped or mixed into a large homogenous batch. In any event, the preloaded tubules 10 are then simply left filled with the cathodoluminescent material and the techniques discussed above are followed. Preferably, when preloaded tubules 10 are used, a further cathodoluminescent material coat applied to the regions between tubules 10 or less preferably to the outer surfaces by one of the above techniques. Still further, tubules 10 could be packed by machine selection in a desired order and placement.

It should also be appreciated that a conductive cathodoluminescent material could be used. In such a case, non-conducting tubules could be used and if the conductive cathodoluminescent material covers all of transparent substrate 12, conductive coating 15 could also be omitted. In fact, transparent substrate 12 could be omitted also as long as the tubule assembly is vacuum tight.

Screen 8 is then mated to a flat addressable electron source 30 to form a display device 40, as shown in FIG. 4. Flat addressable electron source 30 is designed for row-column addressability. In a preferred embodiment, field emitter arrays are used as the electron source 30.

Figure 5:
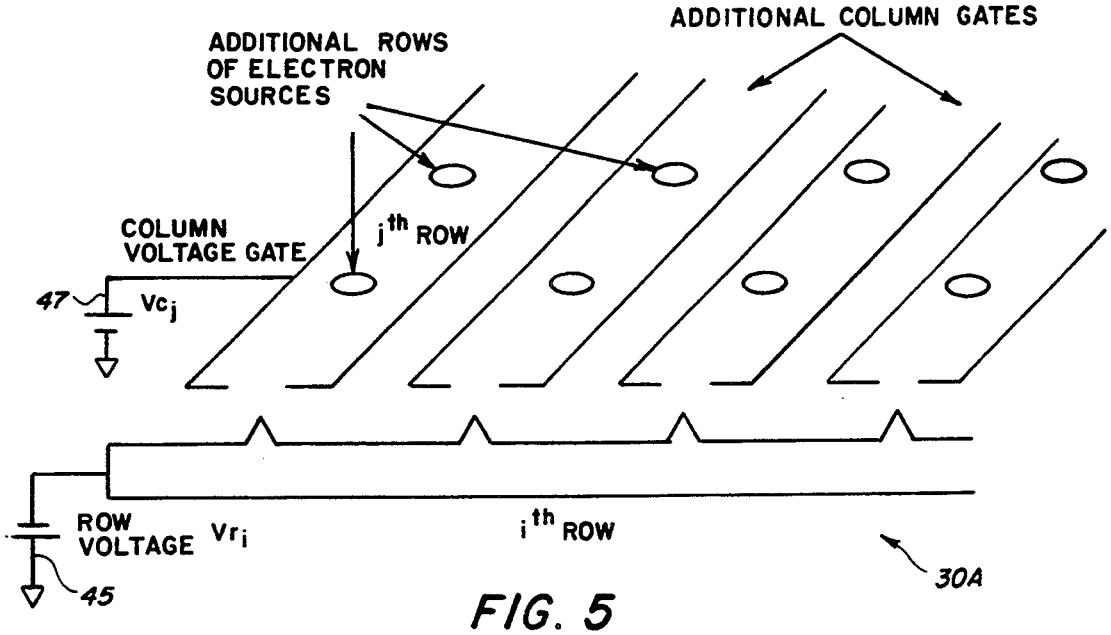
FIG. 5 shows a row-column addressable electron source.

The row-column addressability can be accomplished in many ways. For example, as shown in FIG. 5, a field emitter cell located in the $i^{th}$ row and the $j^{th}$ column can be addressed by row and column. In FIG. 5, $Vr_i$ from row voltage source 45 is the row voltage applied to the emitters in the $i^{th}$ row and $Vc_j$ from column voltage source 47 is the column voltage applied to the gates in the $j^{th}$ column. In operation, for example, if $Vc_k=0$ (not shown) for all columns except the $i^{th}$ column, $Vc_i=+20$ volts and $Vr_l=0$ for all rows except the $j^{th}$ row, and $Vr_j=-20$ volts; then a sufficient extraction voltage (e.g., a 40 volt difference) exists at the row i, column j pixel to extract electrons from the field emitter cell located at that position. All other pixels have an equal to or less than 20 volt difference which is not sufficient to extract electrons from the electron source.

Figure 6:
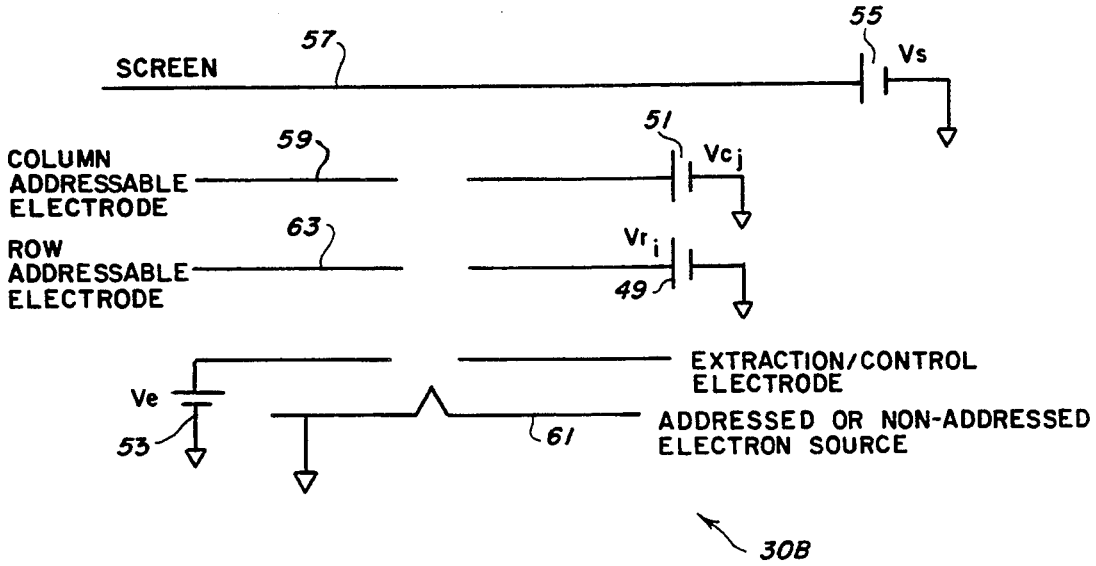
FIG. 6 shows a multi-electrode accelerating and retarding addressable electron source.

In another embodiment of the addressable electron source, multi-electrode accelerating and retarding electrodes can be used such as shown in FIG. 6. In FIG. 6, voltage source 49 develops a row addressable voltage $Vr_i$ for the $i^{th}$ row; voltage source 51 develops a column addressable voltage $Vc_i$ for the $j^{th}$ column; voltage source 53 develops an extraction or control voltage Ve for the electron source 61 and which may be addressable or non-addressable, modulated in time or not modulated in time; and voltage source 55 develops a screen voltage Vs determined by the properties of the phosphor, desired brightness, etc. In operation, for $Vr_i=0$ volts (referenced to ground) or negative voltage with respect to the electron source 61, no electrons pass through the row electrode 63 irrespective of the $j^{th}$ column voltage $Vc_j$ on the column electrode 59. When $Vr_i$ 49 is positive with respect to the electron source 61, e.g., +5 to +100 volts, the electrons pass through the row electrode 63 and traverse toward the column electrode 59. If $Vc_j=0$ volts (with respect to ground) or negative voltage with respect to the electron source 61, no electrons pass through that column electrode 59. However, if $Vc_j$ is positive with respect to the electron source 61, e.g., +5 to +100 volts, the electrons pass through that column electrode 59 and are free to proceed to the screen 57, arriving at the screen 57 with energy Vs to excite that associated pixel phosphor. Consequently, if $Vr_i$ and $Vc_j$ are positive with respect to the electron source 61, the row i and column j pixel is excited. If either $Vr_i$ or $Vc_j$ (or both) is equal to or less than the electron source voltage 61, the row i and column j pixel is not excited.

Figure 7:
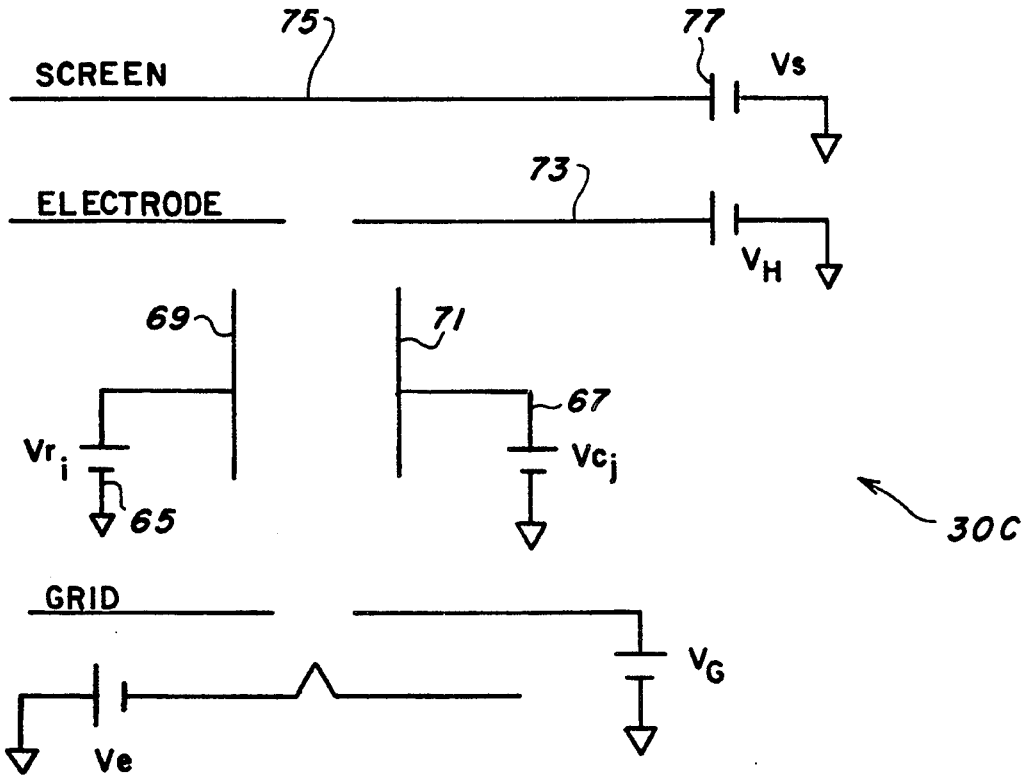
FIG. 7 shows an accelerating, retarding and deflection addressable electron source.

In a third embodiment, accelerating, retarding and deflection electrodes can be used, as shown in FIG. 7. In FIG. 7, row addressability is primarily determined by deflection voltage $Vr_i$ applied to the $i^{th}$ row from a voltage source 65; column addressability is determined by the deflection voltage $Vc_j$ applied to the $j^{th}$ column from a voltage source 67. For example, if all row deflectors 69 except the $i^{th}$ row deflector have −Vr (e.g., −5 to −100 volts) and the $i^{th}$ row deflector has zero voltage, and all column deflectors 71 except the $j^{th}$ column deflector, have +Vr (e.g., +5 to +100 volts) and the $j^{th}$ column deflector has zero voltage, then electrons for the row i, column j pixel will pass through the hole in the H electrode 73 and will proceed to the screen 75 and excite the row i, column j pixel with energy Vs. All other electrons from the other pixels will be deflected toward the column $k^{th}$ electrode 71 and away from the row $l^{th}$ electrode 69 such that they cannot pass through the hole in the H electrode 73.

The foregoing classes of addressable electron sources can be combined with each other in numerous other circuit configurations according to fabrication, engineering or cost considerations.

Referring back to FIG. 4, other electron sources include back-biased p-n junction emitters; metal-insulator-metal emitters; negative electron affinity emitters; negative emitter electron sources; diamond, diamond-filmed and diamond-like electron sources, photo-emitters and similar electron emitting devices. The distance D between flat addressable electron source 30 and display screen 8 is determined by a desired screen voltage and the required spatial resolution. For example, D may be in the range of 30 to 100 micrometers. The desired screen voltage, as appreciated by those of ordinary skill in the art, is determined by a number of factors including: efficiency of the cathodoluminescent material, thickness of the screen, grain size of the cathodoluminescent material, environmental operating conditions such as temperature, and thermal conductivity. If too much voltage is applied, voltage breakdown between the screen and electron source occurs. If the spacing is too large, the spatial resolution is decreased. By optimizing the voltage and distance, the brightness and power efficiency can be optimized. This same procedure can be used to optimize spatial resolution by optimizing the electron and photon path lengths.

Flat addressable electron source 30 can be made, for example, of silicon or metal field emitter arrays. Extending from a top surface of electron source 30 closest to tubules 10 is a plurality of field emitter gates 32 disposed on insulator film 33 and emitter tips 34 positioned between adjacent field emitter gates 32. Electron charges e− are emitted from each emitter tip 34 to respective tubules 10, as illustrated by arrows 36 in FIG. 4. It will also be appreciated that flat addressable electron source 30 is desirable because it also serves as an optically reflecting surface. Thus, backscattered light will be reflected back through display screen 8.

As an alternative to the forming methods and elements discussed above, it should also be appreciated that it may also be possible to form tubules or channels as part of the manufacture or forming process of a field emitter array itself. This would be a simple and compact display device.

Display screen 8 has increased efficiency, and it is appreciated that the efficiency problem of the prior art is solved in several ways. First, efficiency is increased by decreasing the charging problems associated with cathodoluminescent materials by using the conductive tubules and/or substrate. If the cathodoluminescent material becomes charged negative (e.g. it holds onto electrons), the impinging electrons strike the cathodoluminescent material with less energy. Therefore, there is less energy transferred to the cathodoluminescent material to excite it and fewer photons are emitted. By preventing such charging, more energy exchange can occur and more photons can be emitted. Second, efficiency is increased by turning the backscattered light around and shooting it out the front through the cathodoluminescent material and to the observer. Thirdly, efficiency is increased by preventing the light, and the electrons, from scattering into adjacent areas and dissipating energy in the wrong location. Instead, the light and electrons are channelled through and in between the tubules (or whatever channel structures are used).

The "blooming" problem created in the prior art by allowing cathodoluminescent material to charge up too much is also avoided with the present invention. If this charging occurs, the cathodoluminescent material often discharges catastrophically by voltage breakdown and creates flickering, non-uniform brightness, and blooming due to the dispersion in the impinging electron energy and the redirection of the electron trajectory. This problem is solved in the present invention by controlling the cathodoluminescent material charge and electron path as mentioned above.

The chromatic resolution problem of the prior art is solved with the present invention by not allowing light or electrons to scatter into adjacent cathodoluminescent material areas (due to the channelling effect of the tubules).

This invention could be used for cathode ray tube replacements, television (regular, high definition and portable), radar screens, computer terminals, gun sights, aircraft cockpit displays or virtual reality displays, shipboard displays, fire fighting helmet displays, laser protection goggle video displays, helicopter and boat operational display panels, $C^3$ displays, combat troop field data displays (wrist mounted), instrumentation indicators, back lights for liquid crystal displays, projection displays, light bulbs, communication light sources, printing devices, electronic photography printing, etc.

Although the invention has been described in relation to exemplary preferred embodiments thereof, it will be understood by those skilled in this art that still other variations and modifications can be effected in these preferred embodiments without detracting from the scope and spirit of the invention.

What is claimed is:

1. A display screen comprising:

a plurality of channel structures, each said channel structures having a longitudinal axis with a first and second end;

means for holding said plurality of channel structures in a plane with the longitudinal axes thereof perpendicular to the plane; and a cathodoluminescent material deposited on, in, and in between the channel structures, in a preselected region of the channel structure to cause incident electrons and light generated by the incident electrons to be directed along said channel structures.

2. A display screen as claimed in claim 1 and further including a means for removing built up charge from the display screen.

3. A display screen as claimed in claim 2 wherein said means for removing includes conductive channel structures.

4. A display screen as claimed in claim 1 wherein said cathodoluminescent material includes phosphor.

5. A display screen as claimed in claim 1 wherein said cathodoluminescent material includes at least one material for producing a color.

6. A display screen as claimed in claim 1 wherein said cathodoluminescent material includes a plurality of different materials each producing a different color.

7. A display screen as claimed in claim 1 wherein said channel structures are channel plates.

8. A display screen as claimed in claim 1 wherein said channel structure is selected from a group consisting of tubules and channel plates.

9. A display screen as claimed in claim 1 wherein said holding means is a transparent medium formed in a plane to which said channel structures are fixed with said first end thereof facing toward the plane of said transparent medium.

10. A display screen as claimed in claim 9 and further including a means for removing built up charge from the display screen including a conductive said transparent medium.

11. A display screen as claimed in claim 9 wherein said transparent medium is glass.

12. A display screen as claimed in claim 9 wherein said transparent medium is quartz.

13. A display screen as claimed in claim 9 wherein said transparent medium is sapphire.

14. A display screen as claimed in claim 9 wherein said transparent medium is selected from a group consisting of glass, quartz and sapphire.

15. A display screen as claimed in claim 9 wherein said transparent medium is glass, wherein said channel structures are tubules, wherein said cathodoluminscent material is deposited on, in and in between the channel structures, in a preselected region of said channel structure, and wherein said cathodoluminscent material included phosphor.

16. A display screen comprising:

a plurality of channel structures formed into tubules, each said channel structures having a longitudinal axis with a first and second end;

means for holding said plurality of channel structures in a plane with the longitudinal axes thereof perpendicular to the plane; and a cathodoluminescent material deposited on, in and in between the channel structures, in a preselected region of the channel structure to cause incident electrons and light generated by the incident electrons to be directed along said channel structures.

17. A display device comprising:

a display screen including a plurality of channel structures having longitudinal ends, means for holding said plurality of channel structures with the longitudinal ends thereof facing in the same direction, and a cathodoluminescent material deposited on, in, and in between the channel structures, in a preselected region of said channel structure to cause incident electrons and light generated by the incident electrons to be directed along said channel structures; and an addressable electron source means for generating electrons incident on the cathodoluminescent material of selected channel structures.

18. A display device as claimed in claim 17 wherein said electron source means includes a field emitter array.

19. A display device as claimed in claim 17 wherein said electron source means includes a back biased p-n junction.

20. A display device as claimed in claim 17 wherein said electron source means includes a photoemitter.

21. A display device as claimed in claim 17 wherein said electron source means includes a metal-insulated-metal emitter.

22. A display device as claimed in claim 17 wherein said electron source means includes an optically reflecting surface opposite to said display screen.

23. A display device as claimed in claim 17 wherein said electron source means is selected from a group consisting of a field emitter array, a back biased p-n junction, a photoemitter, a metal-insulator-metal emitter, and an optically reflecting surface opposite to said display screen.

24. A display device as claimed in claim 17 wherein said addressable electron source are row-column electrodes.

25. A display device as claimed in claim 17 wherein said addressable electron source are multi-electrode accelerating and retarding electrodes.

26. A display device as claimed in claim 17 wherein said addressable electron source having accelerating, retarding and deflection electrodes.

27. A display device as claimed in claim 17 wherein said addressable electron source is selected from a group consisting of row-column electrodes; multi-electrode accelerating and retarding electrodes; accelerating retarding and deflection electrodes; and any combination of these electrodes.

28. A display device as claimed in claim 17 wherein said holding means includes a transparent medium formed in a plane to which said channel structures are fixed with one longitudinal end thereof facing toward the plane of said transparent medium.

29. A display device as claimed in claim 17 wherein said electron source means included a field emitter array having a reflective surface adjacent said display screen, wherein said transparent medium is glass, wherein said channel structures are hollow tubules, and wherein said cathodoluminscent material includes phosphor which is on, in, and in between said tubules.

* * * * *